US005447418A

United States Patent [19]

Takeda et al.

[11] Patent Number: 5,447,418

[45] Date of Patent: Sep. 5, 1995

[54] SCROLL-TYPE FLUID MACHINE HAVING A SEALED BACK PRESSURE CHAMBER

[75] Inventors: Kimiharu Takeda; Tetuzou Ukai, both of Aichi; Masumi Sekita, Nagoya, all of Japan

[73] Assignee: Mitsubishi Jukogyo Kabushiki Kaisha, Tokyo, Japan

[21] Appl. No.: 223,782

[22] Filed: Apr. 6, 1994

[30] Foreign Application Priority Data

Aug. 30, 1993 [JP] Japan ..... 5-213991

[51] Int. Cl.[6] ..... F01C 1/04; F01C 19/00

[52] U.S. Cl. ..... 418/55.2; 418/55.4; 418/55.5; 418/57; 418/149; 418/179

[58] Field of Search ..... 418/55.2, 55.4, 55.5, 418/57, 149, 179; 277/27, 205, 227, DIG. 6

[56] References Cited

U.S. PATENT DOCUMENTS 4,438,936 3/1984 Schlegel ..... 277/212 C
4,580,790 4/1986 Doose ..... 277/228
5,257,920 11/1993 Takeda ..... 418/55.5

FOREIGN PATENT DOCUMENTS 5157063 6/1993 Japan ..... 418/57

*Primary Examiner*—John J. Vrablik
*Attorney, Agent, or Firm*—Jacobson, Price, Holman & Stern

[57] ABSTRACT

A scroll-type fluid machine in which the high-pressure chamber side (36) of a back pressure chamber (6*a*) using a fixed scroll (11) made of an aluminum base material can be fully sealed. The fixed scroll (11) is made of an aluminum base material, and a discharge cover (2) is made of a ferrous material. Between the U seals (35) interposed between the high-pressure chamber (36) side of the back pressure chamber (6*a*) and the low-pressure side, at least the U seal (35*a*) on the high-pressure chamber (36) side is made of glass-reinforced polytetrafluoroethylene resin, and is installed so as to be pressed against the fixed scroll (11). The U seal withstands a high temperature and large pressure difference and is installed so that the sliding mating part of the U seal (35*a*) is not the fixed scroll (11) made of an aluminum base material which is easily worn, but the discharge cover (2) made of a ferrous material which is less prone to wear.

2 Claims, 5 Drawing Sheets

SCROLL-TYPE FLUID MACHINE HAVING A SEALED BACK PRESSURE CHAMBER

BACKGROUND OF THE INVENTION

The present invention relates to a scroll-type fluid machine which is constructed by combining an orbiting scroll and a fixed scroll.

Air conditioning units have recently used a scroll-type compressor (scroll-type fluid machine) because of its advantage of efficient compression.

The scroll-type compressor, as shown in FIGS. 4 and 5, is constructed so as to have a scroll-type compressor section h which combines a fixed scroll d including a spiral wrap b disposed on an end plate a and a peripheral wall c surrounding the wrap b with an orbiting scroll g including a spiral wrap f disposed on an end plate e.

Specifically, the compressor section h combines the scrolls d and g so that their wraps b,f engage with each other at a predetermined shifted angle to define a plurality of enclosed spaces i for providing compression process between these wraps.

The volume of the enclosed space i decreases gradually from the peripheral side to the center by revolving the orbiting scroll g around the axis of the fixed scroll d using, for example, a rotary shaft k having an eccentric pin j at its tip. That is to say, the compressor section h compresses a gas by taking advantage of the change in its volume. The orbiting scroll g is provided with a rotation checking mechanism, such as an Oldham's ring, for checking the rotation of the orbiting scroll g, though not shown in the figure.

With some of scroll-type compressors of this type, to prevent gas leakage from the enclosed space i, the fixed scroll d is supported in such a manner as to be displaced in the axial direction, and back pressure chambers m,m having a different pressure are disposed on the back surface side of the fixed scroll d as shown in FIG. 4, so that the fixed scroll d is pressed against the orbiting scroll g in the axial direction.

Such a scroll-type compressor conventionally has a construction described below.

On the back surface side of the fixed scroll d, a discharge cover n is installed to define back pressure chambers m,m between the discharge cover n and the end plate a.

On the back surface of the end plate a of the fixed scroll d, large and small flanges o and p protrude concentrically, whereas on the inner surface of the discharge cover n, concentric flanges q and q protrude so as to engage with the flanges o and p. The engagement of the flanges o and p with the flanges q and q concentrically partitions the back pressure chambers m,m between the end plate a and the discharge cover n. Thus, the back pressure chambers m,m are divided into chambers with a different pressure: for example, a high-pressure chamber r is provided at the center, and an intermediate-pressure chamber is provided around the high-pressure chamber r.

Between the flanges for partitioning the back pressure chambers into the high-pressure chamber side and the low-pressure side, seal members t are interposed to seal the flanges. The fixed scroll d is pressed against the orbiting scroll g by using a discharge pressure and a pressure under compression introduced into the high-pressure chamber r and the intermediate-pressure chamber s.

The seal members t, t used for sealing the back pressure chambers m, m consist of U seals, which are suitable for moving parts, not O-rings, because the fixed scroll d can be displaced.

For the scroll-type compressor, consideration has been given to making the fixed scroll d and the orbiting scroll g of aluminum with the discharge cover being made of ferrous material in order to ensure low cost and light weight.

If the fixed scroll d is made of aluminum, the seal between the high-pressure chamber r and the intermediate-pressure chamber s must overcome a problem of difficulty in sealing because aluminum is a soft material, as well as problems of high temperature and large pressure difference.

Specifically, since the fixed scroll d is displaced relative to the orbiting scroll g side by the back pressure, the aluminum portion in contact with the U seal is easily worn due to the displacement of the fixed scroll d.

For this reason, the technique in which a U seal is merely interposed between the flanges cannot be applied to the scroll-type compressor.

Therefore, a seal construction suitable for the compressor section h having the fixed scroll d made of aluminum has been recommended strongly.

BRIEF SUMMARY OF THE INVENTION

The present invention has been made in view of the above situation. Accordingly, an object of the present invention is to provide a scroll-type fluid machine in which the high-pressure chamber side of a back pressure chamber formed by using a fixed scroll made of an aluminum base material can be fully sealed.

To achieve the above object, in a scroll-type fluid machine including: a compressor section in which a fixed scroll, which is displaced axially, is engaged with an orbiting scroll; a discharge cover which forms a back pressure chamber between an end plate of the fixed scroll and the discharge cover on the back surface side of the end plate of the fixed scroll; the fixed scroll having first and third flanges protruding concentrically on the back surface of the end plate thereof; the discharge cover having a second flange protruding concentrically so as to engage with the flanges on the fixed scroll side, on the inner surface thereof; the back pressure chamber formed between the first and third flanges, the end plate, and the second flange being used to introduce a pressure under compression with respect to the pressure in a discharge high-pressure chamber formed at the center of concentric circle; and U seals interposed between the flanges partitioning the high-pressure chamber side and the low-pressure side of the back pressure chamber to provide sealing between the flanges, the present invention is constituted as follows:

The scroll-type fluid machine of this invention is characterized in that the fixed scroll is made of an aluminum base material, and the discharge cover is made of a ferrous material, and between the U seals interposed between the high-pressure chamber side of the back pressure chamber and the low-pressure side, at least the U seal on the high-pressure chamber side is made of glass-reinforced polytetrafluoroethylene resin, and is installed so as to be pressed against the fixed scroll made of an aluminum base material;

In one embodiment the U seal on the low-pressure side, which is subjected to a lower load (low temperature and small pressure difference), is made of polytetrafluoroethylene resin with aromatic resin to seal the back pressure chamber at a cost as low as possible.

Another embodiment of the invention is characterized in that even on the low pressure side which is subjected to lower load (low temperature and small pressure difference), the U seal on the low-pressure side is installed so as to be pressed against the fixed scroll made of an aluminum base material to prevent the wear of the fixed scroll as much as possible.

The operation of the scroll-type fluid machine of the invention wherein the U seal is made of glass-reinforced polytetrafluoroethylene resin withstands high temperature and a large pressure difference on the high-temperature chamber side of the back pressure chamber.

Also, since the U seal is installed so as to be pressed against the fixed scroll made of an aluminum base material, the sliding mating part of the U seal is not the fixed scroll made of an aluminum material which is easily worn by the glass-reinforced polytetrafluoroethylene resin material, but the discharge cover made of a ferrous material which is less prone to wear.

This construction overcomes problems of high temperature, large pressure difference, and difficulty in sealing.

That is to say, the high-pressure chamber side of the back pressure chamber formed on the fixed scroll made of an aluminum base material is fully sealed.

The operation of the scroll-type fluid machine in a further embodiment is such that, in addition to the aforementioned operation, the U seal on the low-pressure side, which is subjected to a lower load (low temperature and small pressure difference), is made of polytetrafluoroethylene resin with aromatic resin, which has properties meeting the aforementioned environmental conditions, though being inferior in property to the glass-reinforced polytetrafluoroethylene resin material. The U seal is made of polytetrafluoroethylene resin with aromatic resin, which reduces wear on the part made of an aluminum base material and is inexpensive, so that the cost for sealing the back pressure is low.

The operation of the scroll-type fluid machine defined in another embodiment is such that the U seal on the low-pressure side of the back pressure chamber is also installed so that the sliding mating part of the U seal is not the fixed scroll made of an aluminum material, but the discharge cover made of a ferrous material which is less prone to wear. This provides high sealing property.

As described above, according to the invention sealing of the high-pressure chamber side of the back pressure chamber can be achieved when the fixed scroll of an aluminum base material is used, though such sealing has been thought to be difficult to achieve.

The U seal made of polytetrafluoroethylene resin with aromatic resin, which has necessary properties and is inexpensive, is used to seal the low-pressure side of the back pressure chamber, so that the cost for sealing the back pressure chamber is low.

The U seal on the low-pressure side of the back pressure chamber is also installed so that the sliding mating part of the U seal is not the fixed scroll made of an aluminum material, but the discharge cover made of a ferrous material which is less prone to wear. This provides more stable, high sealing property.

BRIEF DESCRIPTION OF THE DRAWINGS

The invention will now be described in detail with reference to the accompanying drawings wherein.

DETAILED DESCRIPTION OF PREFERRED EMBODIMENTS

A first embodiment of the present invention will be described below with reference to FIGS. 1 and 2.

Figure 2:
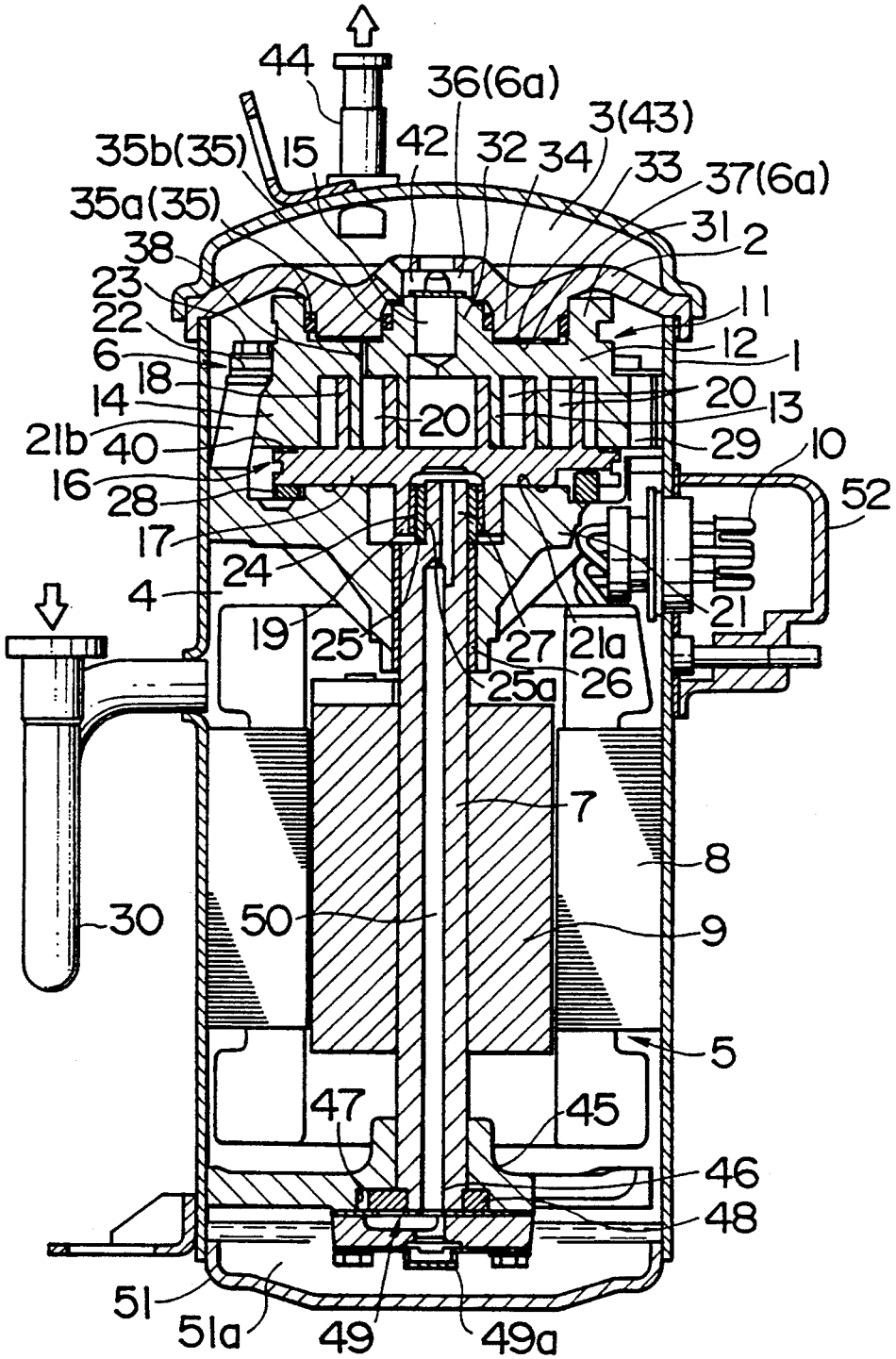
FIG. 2 is a cross-sectional view showing the construction of a scroll-type compressor to which the present invention is applied.

FIG. 2 shows the construction of a scroll-type compressor to which the present invention is applied. In the figure, reference numeral 1 denotes a closed housing.

The closed housing 1 is constructed in a cylindrical form extending vertically. On the upper side of the interior of the closed housing 1, a discharge cover 2 formed of a ferrous material is disposed so as to vertically partition the interior of the closed housing 1. With this discharge cover 2 being a boundary, the interior of the closed housing 1 is divided into upper and lower parts: the upper part is a high-pressure side 3, and the lower part is a low-pressure side 4.

At the low-pressure side 4 of the closed housing 1, an electric motor 5 is installed at the lower part, and a scroll-type compressor section 6 is at the upper part. Between the electric motor 5 and the compressor section 6, a rotary shaft 7 extends.

The electric motor 5 has a stator 8 which is pressed into and supported by the inner peripheral portion of the closed housing 1 and a rotor 9 which is arranged inside the stator 8. The rotor 9 is fixed to the lower part of the rotary shaft 7 to output the rotation by means of the rotary shaft 7. A terminal 10 connected to the stator 8 is installed at the outer periphery of the closed housing 1.

The scroll-type compressor section 6 has a fixed scroll 11 made of an aluminum base material and an orbiting scroll 16 likewise made of an aluminum base material, which engages with the fixed scroll 11.

Figure 5:
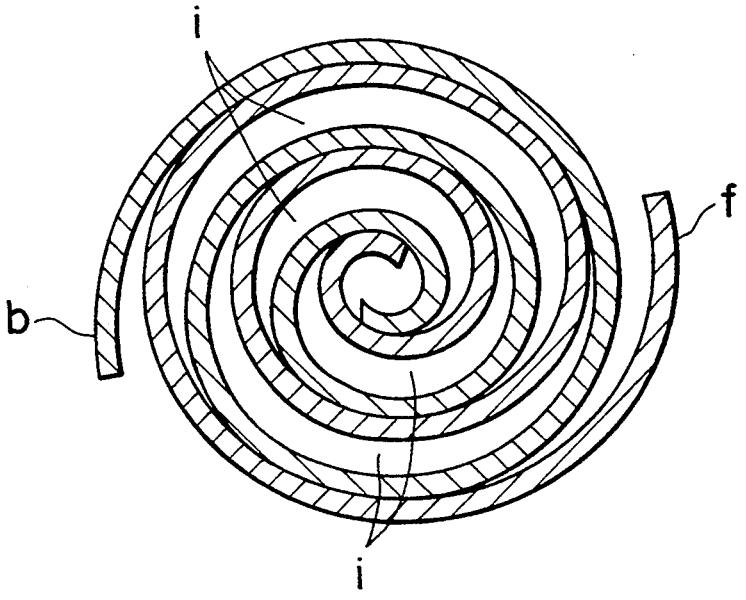
FIG. 5 PRIOR ART
FIG. 5 is a cross-sectional view showing the engagement of wraps of a fixed scroll and an orbiting scroll of the compressor section.

The fixed scroll 11 has an end plate 12, a spiral wrap 13 (the same as the wrap shown in FIG. 5) disposed on the inner surface of the end plate 12, and a peripheral wall 14 surrounding the wrap 13. The end plate has a discharge port 15 at the center thereof.

The orbiting scroll 16 has an end plate 17 and a spiral wrap 18 (the same as the wrap shown in FIG. 5) disposed on the inner surface of the end plate 17. The end plate 17 has a cylindrical boss 19 at the center of the outer surface thereof.

The fixed scroll 11 and the orbiting scroll 16 are combined so that the wrap 13 engages with the wrap 18 at a shifted angle of 180 degrees (a predetermined angle). Therefore, a plurality of crescent-shaped enclosed spaces 20 (the same as the enclosed spaces shown in FIG. 5) for providing the compression process are formed between the wraps surrounded by the end plate portions.

The combined scrolls 11 and 16 are interposed between the discharge cover 2 and a casing-shaped main frame 21 fixed to the upper side of the low-pressure side 4, with the fixed scroll 11 being on the upper side and the orbiting scroll 16 being on the lower side.

The end plate 17 of the orbiting scroll 16 is slidably disposed on a horizontal bearing surface 21*a* formed on the upper surface of the main frame 21.

The fixed scroll 11 is supported so as to be displaced vertically with respect to the peripheral wall 21*b* formed at the outer periphery of the main frame 21 via a support spring 22. Specifically, the fixed scroll 11 is provided with a bracket 23 protruding to the side of the peripheral wall 21*b*, and the bracket 23 is fixed to the upper part of the peripheral wall 21*b* via the support spring 22.

A suction port (not shown) formed in the peripheral wall 14 of the fixed scroll 11 communicates with a space 29 at the side of the peripheral wall 14, a suction passage (not shown) which is formed in the main frame 21 and connects both sides of the main frame 21 with each other, and a suction tube 30 connected to the outer periphery of the closed housing 1 through the low-pressure side 4, so that a gas from the outside can be admitted to the compressor section 6.

In the boss 19 of the orbiting scroll 16, a drive bushing 25 is inserted via a rotating bearing 24. This drive bushing 25 has a slide hole 25*a* formed of a through hole extending to some extent in the radial direction.

The upper end of the rotary shaft 7 passes through the main frame 21 and extends toward the center of the end plate of the orbiting scroll 16. The upper end of the rotary shaft 7 is rotatably supported by an upper bearing 26 installed at the pierced portion of the main frame 21. At the upper end of the rotary shaft 7, an eccentric pin 27 is projected. This eccentric pin 27 is slidably inserted into the slide hole 25*a*. Therefore, the orbiting scroll 16 revolves around the axis of the fixed scroll 11 as the rotary shaft 7 rotates.

Between the end surface 17 of the orbiting scroll 16 and the bearing surface 21*a* of the main frame 21, a rotation checking mechanism, e.g. the Oldham's ring 28, is interposed, which mechanism allows the revolution of the orbiting scroll 16, but checks the rotation thereof.

By the revolution of the orbiting scroll 16, which is provided by the Oldham's ring 28 and the eccentric pin 27, the volume of the enclosed space 20 is decreased gradually. Thus, a gas can be compressed in this enclosed space 20.

On the top of the end plate 12 of the fixed scroll 11, two large and small cylindrical flanges, a first flange 31 and a third flange 32, project upward with their center being aligned with the axis of the end plate 12.

On the inner surface of the discharge cover 2 is formed a cylindrical second flange 34 which projects toward the annular concavity 33 formed between the first flange 31 and the third flange 32. This second flange 34 is slidably inserted in the concavity 33. In other words, the second flange 34 engages with the first flange 31 and the third flange 32.

Between the side surfaces where the second flange 34 slides over the flanges 31 and 32, annular U seals 35*a* and 35*b* are interposed, respectively, so that a back pressure chamber 6*a* formed between the inner surface of the discharge cover 2 and the back surface of the end plate 12 of the fixed scroll 11 opposed to the discharge cover 2 is partitioned concentrically into back pressure chambers having a different pressure.

Thus, a high-pressure chamber 36 is formed in the central region partitioned by the inner U seal 35*a*, that is, at the central portion on the top of the end plate 12 covered by the central portion of the discharge cover 2. Also, an intermediate-pressure chamber 37 is formed in the intermediate region partitioned by the outer U seal 35*b*, that is, at the intermediate portion on the top of the end plate 12 covered by the intermediate portion of the discharge cover 2. Further, a low-pressure chamber in the space 29 having the same pressure as the suction pressure, is formed on the outer peripheral side of the intermediate-pressure chamber 37.

The present invention uses a construction in which the back pressure chambers 36, 37 are sealed.

The sealing construction of the back pressure chambers 36, 37 will now be described. The U seal on the high-pressure chamber side is a U seal 35*a* made of glass-reinforced polytetrafluoroethylene resin which is suitable for high temperature and large pressure difference. One type of the polytetrafluoroethylene resin is "Teflon" (trade mark name of Du Pont).

Figure 1:
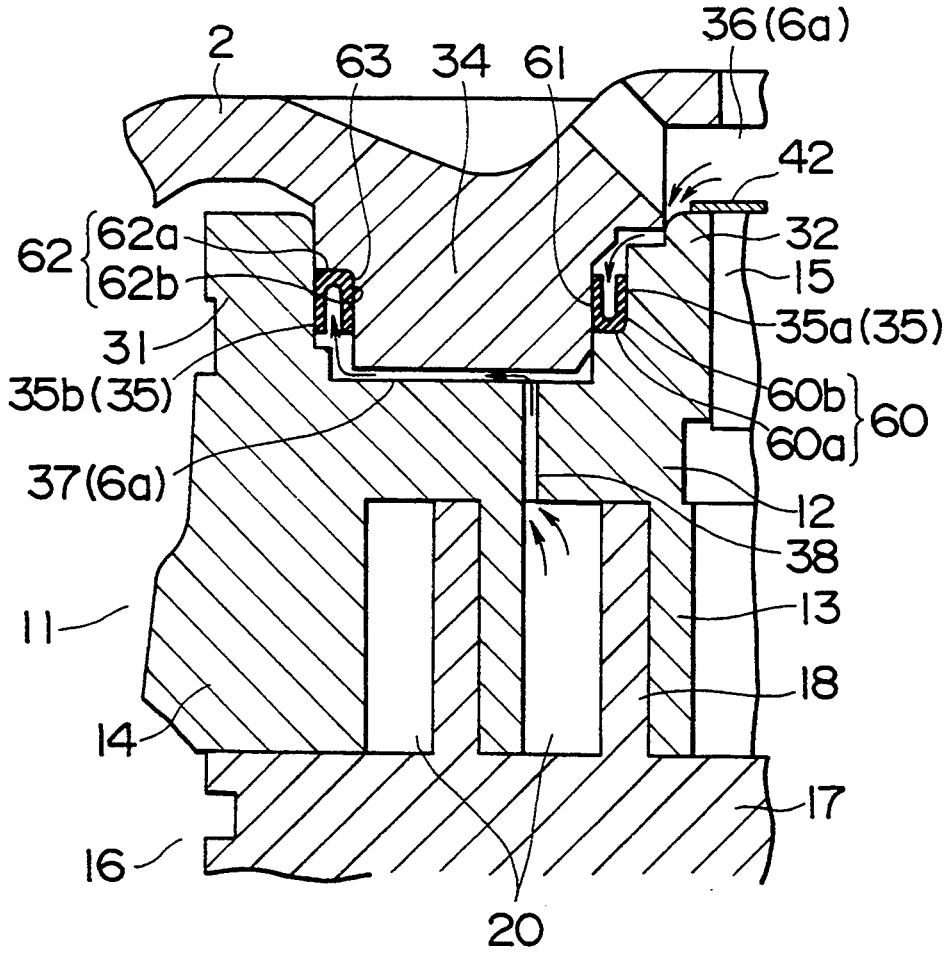
FIG. 1 is a cross-sectional view showing the construction around U seals for sealing back pressure chambers in the main part of a scroll-type compressor in accordance with a first embodiment of the present invention.

The U seal 35*a* is installed in such a manner as shown in the enlarged cross-sectional view of FIG. 1.

Reference numeral 60 denotes a step formed on the outer peripheral surface of the flange 32. The step 60 has a horizontal surface 60*a* on the base side of the flange 32 and a vertical surface 60*b* extending continuously from the horizontal surface 60*a* on the tip side.

A seal housing portion 61 is formed of an annular groove portion surrounded by the step 60 and the inner peripheral surface of the second flange 34 of the discharge cover 2.

The seal housing portion 61 contains the U seal 35*a* with its seal tip side (closed side), that is, the pressing direction, facing the horizontal surface 60*a*.

The U seal 35*a* thus installed is pressed against the horizontal surface 60*a* when being subjected to a pressure from the high-pressure chamber 36. That is to say, the U seal 35*a* is installed so as to be pressed against the fixed scroll 11.

Thus, the U seal 35*a* is held by the fixed scroll 11, and its sliding mating part is the inner peripheral surface of the flange 34, that is, the discharge cover 2 made of a ferrous material which is less prone to wear.

The U seal on the low-pressure side is a U seal 35*b* made of polytetrafluoroethylene resin with aromatic resin which is suitable for a low-temperature side seal for lower temperature and smaller pressure difference than the high-temperature chamber side. One type of the polytetrafluoroethylene resin with aromatic resin is the aforementioned "Teflon" with "Econol".

The U seal 35*b* is installed in such a manner as shown in the enlarged cross-sectional view of FIG. 1.

Reference numeral 62 denotes a step formed on the outer peripheral surface of the flange 34. The step 62 has a horizontal surface 62*a* on the base side of the flange 34 and a vertical surface 62*b* extending continuously from the horizontal surface 62*a* on the tip side.

A seal housing portion 63 is formed by an annular groove portion surrounded by the step 62 and the inner peripheral surface of the first flange 31 of the fixed scroll 11.

The seal housing portion 63 contains the U seal 35*b* with its seal tip side (closed side), that is, the pressing direction, facing the horizontal surface 62*a*.

The U seal 35*b* thus installed is pressed against the horizontal surface 62*a* when being subjected to a pressure from the intermediate-pressure chamber 37. That is to say, the U seal 35*b* is installed so as to be pressed against the discharge cover 2.

Among the high-pressure chamber 36, intermediate-pressure chamber 37, and low-pressure chamber, the high-pressure chamber 36 communicates with the discharge port 15. The intermediate-pressure chamber 37 communicates with the enclosed space 20 under compression through a pressure introducing hole 38 formed in the end plate 12. The fixed scroll 11 floating above is pressed against the orbiting scroll 16 in the axial direction while being sealed by the U seals 35*a* and 35*b* by the gases of high and intermediate pressures introduced into the high-pressure chamber 36 and the intermediate-pressure chamber 37, respectively.

The peripheral portion of the orbiting scroll 16, which is slidingly in contact with the axial end surface of the peripheral wall 14 of the fixed scroll 11, is provided with a wear-resistant plate 40 formed in a ring shape. This wear-resistant plate 40 prevents wear caused by a force which rotates the orbiting scroll 16 in the reverse direction during operation.

A check valve 42 is installed in the discharge port 15 to prevent reverse flow. The discharge port 15 communicates with a discharge chamber 43 defined by a space on the high-pressure side 3. This discharge chamber 43 communicates with a discharge pipe 44 connected to the upper wall of the closed housing 1, so that the gas discharged into the discharge chamber 43 is discharged to the outside of the closed housing 1.

The lower end portion of the rotary shaft 7 extends to the inner bottom side of the closed housing 1, and is rotatably supported by a lower bearing member 45 mounted at the lower side of the low-pressure side 4.

At the lower end of the rotary shaft 7, an oil pump 49 of a forced feed mechanism is installed, which oil pump produces pumping action by oscillating an orbiting ring 48 housed in a cylinder 47, for example, by rotating an eccentric shaft 46. The suction portion (not shown) of the oil pump 49 communicates with oil reservoir 51 situated at the inner bottom of the closed housing 1, so that the oil 51*a* accumulated in the oil reservoir 51 is sucked. The discharge portion of the oil pump 49 communicates with the sliding portions of the compressor section 6 through an oil passage 50 formed in the rotary shaft 7, so that the oil 51*a* in the oil reservoir 51 can be fed under pressure to any place requiring lubrication.

A relief valve 49*a* is installed at the discharge portion of the oil pump 49 to return the oil 51*a* to the oil reservoir 51 when a predetermined pressure is exceeded.

Reference numeral 52 denotes a terminal cover for covering the terminal 10 exposed to the outside of the closed housing 1.

Next, the operation of the scroll-type compressor constituted as described above will be described. When the motor 5 is energized through the terminal 10, the rotor 9 rotates. The rotation of the rotor 9 is transmitted to the oil pump 49 through the rotary shaft 7.

Then, the eccentric pin 46 of the oil pump 49 is rotated eccentrically, and the orbiting ring 40 is oscillated.

Thus, the oil 51*a* in the oil reservoir 51 is sucked from the suction portion of the oil pump 49, and discharged from the discharge portion. The discharged oil 51*a* is fed under pressure to parts requiring the oil 51*a* such as the sliding portions of the compressor section 6 through the oil passage 50.

On the other hand, the rotation of the motor 5 is transmitted to the orbiting scroll 16 via the rotary shaft 7, the eccentric pin 27, and the boss 19.

Since the rotation of the orbiting scroll 16 is checked by the Oldham's ring 28, the entire orbiting scroll 16 does not rotate, but the orbiting scroll 16 revolves on a circular locus having the revolution radius with the axis center of the fixed scroll 11 being the center.

The enclosed space 20 formed between the fixed scroll 11 and the orbiting scroll 16 is changed by the revolving motion in such a manner that its volume is decreased.

By this operation, the sucked gas is fed to the outermost region of the wraps 13 and 18 through the suction tube 30, the low-pressure side 4, a suction passage, and a suction port (either is not shown), and sucked from the region into the enclosed space 20.

The sucked gas reaches the central portion while being compressed gradually as the volume of the enclosed space 20 is decreased by the revolving motion of the orbiting scroll 16.

At this time, the gas at discharge pressure is fed into the high-pressure chamber 36 through the discharge port 15, whereas the gas of intermediate pressure under compression is fed into the intermediate-pressure chamber 37 through the pressure introducing hole 38.

The fixed scroll 11 is pressed against the orbiting scroll 16 by the discharge pressure in the high-pressure chamber 36 and the intermediate pressure in the intermediate-pressure chamber 37.

At this time, the U seal 35*a* is pressed against the fixed scroll 11 by the discharge pressure in the high-pressure chamber 36, whereas the U seal 35*b* is pressed against the discharge cover 2 by the intermediate pressure.

The fixed scroll 11 is displaced relative to the orbiting scroll 16 while sliding between the U seal 35*a* and the flange 34 (discharge cover 2) and between the U seal 35*b* and the flange 31 (fixed scroll 11).

Thus, the compression process in the enclosed space 20 proceeds while gas leakage is prevented.

The gas compressed to a predetermined pressure is discharged from the discharge port 15 to the outside of the closed housing 1 through the check valve 42, the discharge chamber 43, and the discharge pipe 44.

During the operation of the scroll-type compressor, the U seal 35*a*, which provides sealing between the high-pressure chamber 36 and the intermediate-pressure chamber 37, is subjected to a high temperature and a large pressure difference. However, the sealing property of the U seal 35*a* is not impaired by the high temperature and large pressure difference because it is made of glass-reinforced polytetrafluoroethylene resin.

The U seal 35*a* is installed so that the pressing direction is toward the fixed scroll 11. Therefore, the sliding mating part of the U seal 35*a* is not the fixed scroll 11 made of an aluminum base material which is easily worn by the glass-reinforced polytetrafluoroethylene resin material, but the discharge cover 2 made of a ferrous material which is less prone to wear.

Therefore, sealing of the high-pressure chamber 36 side can be achieved when the fixed scroll 11 of an aluminum base material is used, though such sealing has been thought to be difficult to achieve.

The seal on the low-pressure side of the back pressure chamber 6*a*, where the temperature is lower and the pressure difference is smaller than on the high-pressure chamber 36 side, has properties meeting the aforementioned environmental conditions, though being inferior in property to the seal made of glass-reinforced polytetrafluoroethylene resin. The U seal 35*b* is made of polytetrafluoroethylene resin with aromatic resin, which reduces wear on the part made of an aluminum base material and is inexpensive, so that the cost for sealing the back pressure chamber 6*a* is low.

Figure 3:
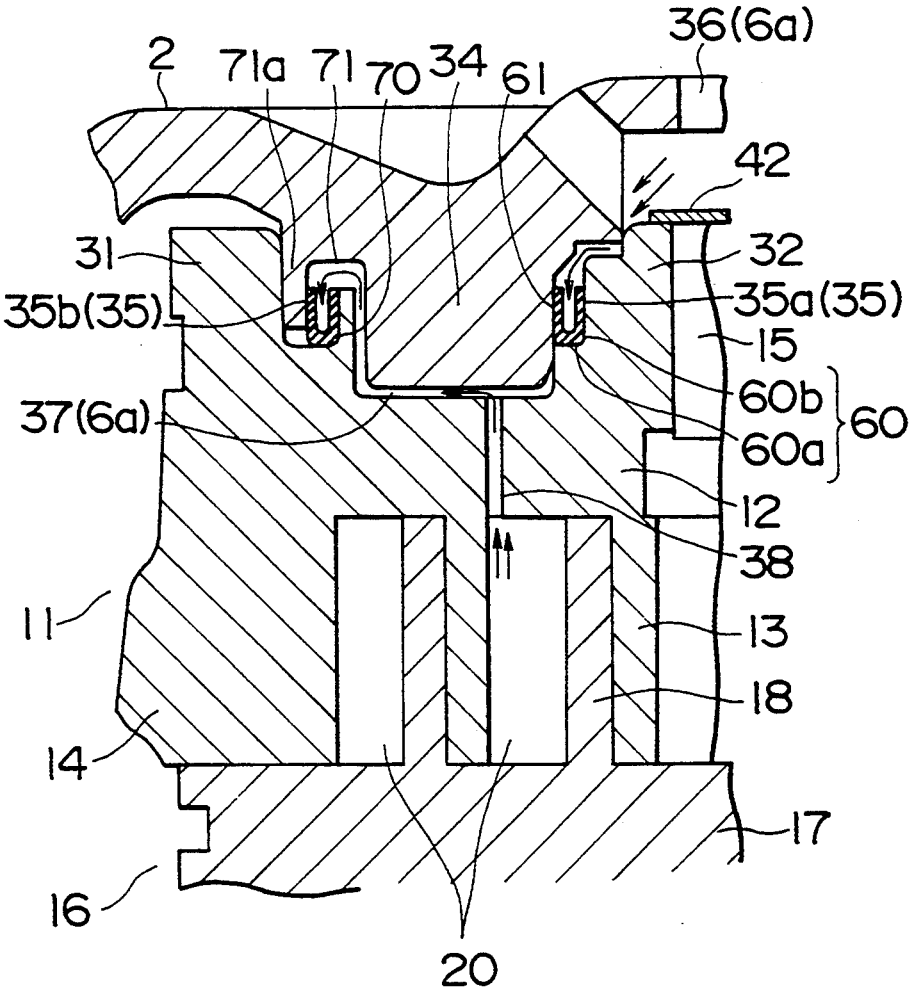
FIG. 3 is a cross-sectional view showing the construction around U seals for sealing back pressure chambers in the main part of a scroll-type compressor in accordance with a second embodiment of the present invention.
Figure 4:
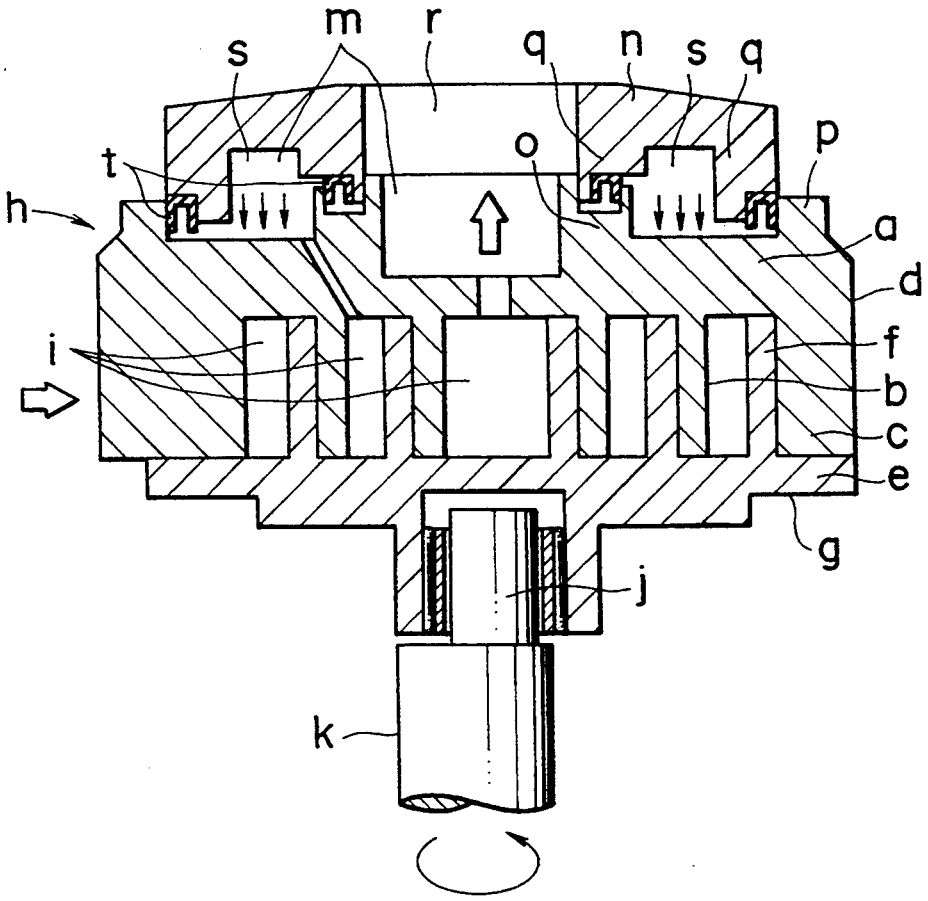
FIG. 4 PRIOR ART
FIG. 4 is a cross-sectional view for illustrating a compressor section of a conventional scroll-type compressor.

FIG. 3 shows a second embodiment of the present invention.

In this embodiment, the U seal 35*b* on the low-pressure side is installed so as to be pressed against the fixed scroll 11, not against the discharge cover 2.

Specifically, a seal housing portion 70 consisting of an annular concave portion is formed at the inner peripheral surface side of the flange 31. The U seal 35*b* is housed in the seal housing portion 70 with its tip facing the bottom of the concave portion, and a protrusion 71*a* of the annular concave portion 71 formed at the outer peripheral surface side of the flange 34 is interposed between the outer peripheral surface of the U seal 35*b* and the side surface of the concave portion opposed to the surface of the U seal 35*b*.

If the U seal 35*b* is installed as described above, the sliding mating part of the U seal 35*b* is not the fixed scroll 11 made of an aluminum-base material, but the discharge cover 2 made of a ferrous material which is less prone to wear. This provides more stable, high sealing property, and ensures high durability (reliability).

In the second embodiment, like reference numerals are applied to the same elements as those in the aforementioned first embodiment, and the description of those elements is omitted.

Although the present invention has been applied to a scroll-type compressor in both above-described embodiments, the present invention is not limited to the application for a scroll-type compressor, but can be applied to other scroll-type fluid machines including expanders.

We claim:

1. In a scroll-type fluid machine, including an axially displaceable fixed scroll having a central axis and an end plate, a spiral wrap on said end plate, a peripheral wall surrounding said spiral wrap and an axial end surface on said end plate, an orbiting scroll having a central axis and an end plate, a spiral wrap on said end plate of said orbiting scroll engaging with said spiral wrap on said fixed scroll, one of said scrolls being axially pressed against the other of said scrolls, and an axial end surface on said end plate of said orbiting scroll and having a peripheral portion, the improvement comprising:

a first substantially cylindrical inner flange protruding from said axial end surface on said end plate of said fixed scroll and having a central axis aligned with said central axis of said fixed scroll;

an outer substantially cylindrical flange extending from said axial end surface on said end plate of said fixed scroll radially outwardly of and in concentric spaced relationship with respect to said inner flange;

a discharge cover having a substantially circumferential intermediate flange concentric with and protruding between said inner and outer flanges;

facing surfaces on said inner and outer flanges and inner and outer facing surfaces on said intermediate flange, said facing surfaces on said inner and outer flanges facing said inner and outer facing surfaces on said intermediate flange, respectively;

surfaces on said intermediate flange engaging said facing services on said inner and outer flanges;

a back pressure chamber formed between said inner and outer flanges, said axial end surface on said end plate of said fixed scroll, and said intermediate flange;

a discharge high pressure-chamber between said discharge cover, said inner flange and said intermediate flange and disposed centrally with respect to said flanges;

an inner U seal between and in engaging sealing relationship with said facing surface on said inner flange and said inner facing surface on said intermediate flange;

an outer U seal between and in engaging sealing relationship with said outer facing surface on said intermediate flange and said facing surface on said outer flange;

said back pressure chamber comprising an intermediate pressure chamber between said inner and outer seals, said intermediate flange and said inner and outer flanges, said inner U seal sealing said intermediate pressure chamber from said high-pressure chamber;

said fixed scroll being made of an aluminum based material;

said discharge cover being made of a ferrous material;

said inner U seal being made of glass-reinforced polytetrafluoroethylene resin and being positioned for pressing against said fixed scroll by pressure in said high-pressure chamber; and said outer U seal being made of polytetrafluoroethylene resin with aromatic resin.

2. The scroll-type fluid machine as claimed in claim 1 wherein:

said outer U seal is positioned so that said outer seal is pressed against said discharge cover by pressure in said intermediate pressure chamber.

* * * * *